United States Patent [19]

Hufstader

[11] Patent Number: 4,893,995

[45] Date of Patent: Jan. 16, 1990

[54] ELECTRIC MOTOR-DRIVEN IMPELLER-TYPE AIR PUMP

[75] Inventor: Gibson O. Hufstader, Utica, Mich.

[73] Assignee: General Motors Corporation, Detroit, Mich.

[21] Appl. No.: 280,044

[22] Filed: Dec. 5, 1988

[51] Int. Cl.[4] ..... F04D 29/28

[52] U.S. Cl. ..... 417/370; 417/423.15; 417/423.14; 415/204; 415/169.1

[58] Field of Search ..... 417/370, 424.1, 357, 417/423.14, 423.9, 423.15, 423.11, 542; 60/307, 284; 415/219 C

[56] References Cited

U.S. PATENT DOCUMENTS

| | | | |
|---|---|---|---|
| 2,386,508 | 10/1945 | Ripley | 417/423.14 |
| 2,843,314 | 7/1958 | Hansen | 415/119 |
| 3,125,286 | 3/1964 | Sanders | 415/119 |
| 3,168,806 | 2/1965 | Calvert | 60/284 |
| 3,220,349 | 11/1965 | White | 417/370 |
| 3,301,472 | 1/1967 | Dixon et al. | 415/206 |
| 3,751,914 | 8/1973 | Pollock | 60/284 |
| 3,775,064 | 11/1973 | Berger et al. | 60/307 |
| 4,080,121 | 3/1978 | Goloff et al. | 418/149 |
| 4,508,486 | 4/1985 | Tinker | 415/119 |

*Primary Examiner*—Donald E. Stout
*Assistant Examiner*—David W. Scheuermann
*Attorney, Agent, or Firm*—C. K. Veenstra

[57] ABSTRACT

A high speed electric motor drives an impeller to centrifugally induce air flow to an engine exhaust system. The motor is sealed within a noise attenuating cover, and the impeller induces a portion of the air flow to recirculate through the sealed motor chamber to cool the motor. A noise attenuating duct is mounted on the pump inlet. The duct includes an elongated neck of rectangular cross-section extending at an angle from a tubular body, the remote end of said neck being tapered, each side of the neck having a series of parallel inlet louvers, and the body having an internal foam liner.

3 Claims, 4 Drawing Sheets

ELECTRIC MOTOR-DRIVEN IMPELLER-TYPE AIR PUMP

TECHNICAL FIELD

This invention provides an electrically operated air pump suitable for supplying air to the exhaust system of an automotive engine.

BACKGROUND

Automotive engines often have an air pump that supplies air to the engine exhaust system. The air supports combustion of hydrocarbons and carbon monoxide in the exhaust system to minimize emission of those compounds into the atmosphere.

In the past, such air pumps generally have had a mechanical drive from the engine and accordingly consumed power from the engine during all operating modes. In many applications, however, air is required to support combustion in the exhaust system only during the initial period of engine warm-up. Thus in those applications, the air pump has undesirably consumed engine power after the initial period of engine warm-up.

SUMMARY OF THE INVENTION

This invention provides an electrically operated air pump that may be operated to supply air to an engine exhaust system only during those periods when air is required to support combustion in the engine exhaust system. This air pump accordingly consumes power only when necessary.

In an air pump employing this invention, a high speed electric motor drives impeller in a housing to induce air flow. The air pump includes provision for attenuating air pump operating noise, and also includes provision for recirculating a portion of the air flow around the motor to prevent overheating.

The details as well as other features and advantages of a preferred embodiment of this air pump are set forth in the remainder of the specification and are shown in the accompanying drawings.

THE PREFERRED EMBODIMENT

Figure 1:
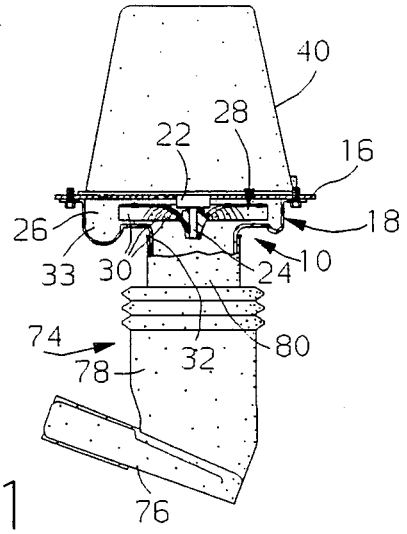
FIG. 1 is a view of a preferred embodiment of the air pump, including its inlet duct, a portion of the pump being broken away to show the impeller.
Figure 2:
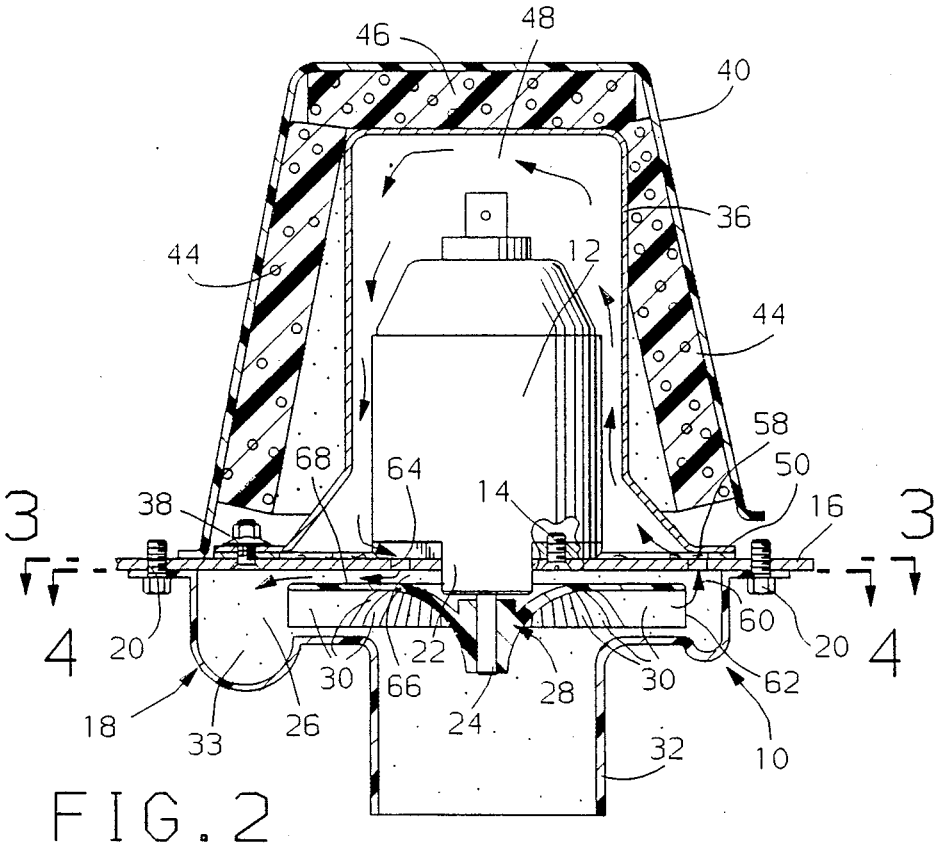
FIG. 2 is an enlarged axial sectional view of the FIG. 1 air pump, without its inlet duct, showing the structure for attenuating electric motor operating noise, and further showing a portion of the flow path for recirculating a portion of the air flow around the electric motor.
Figure 3:
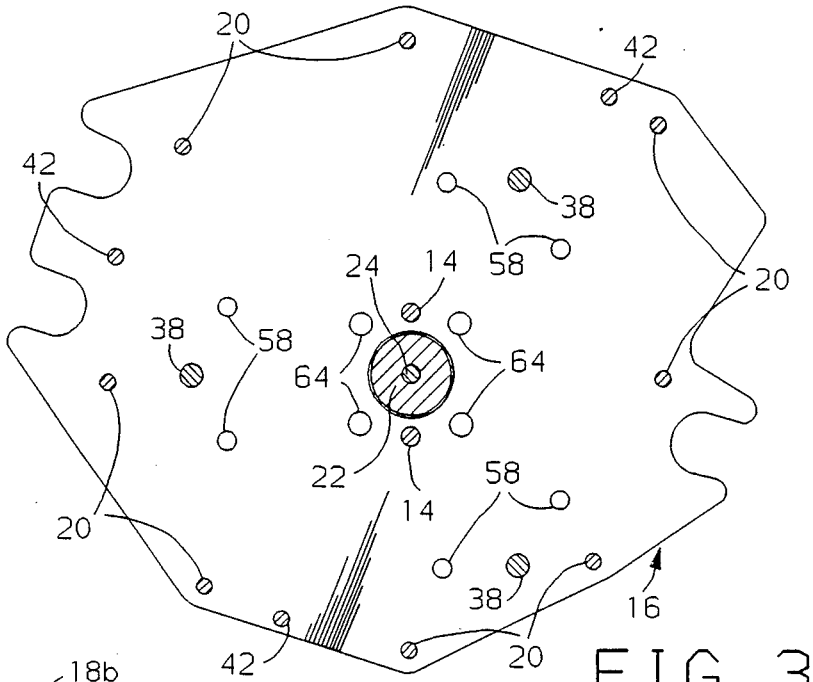
FIG. 3 is a sectional view, taken along line 3—3 of FIG. 1, showing the inlet and outlet apertures that recirculate a portion of the air flow around the electric motor.
Figure 4A:
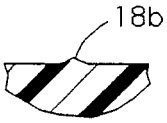
FIG. 4A is a section through the rim of the FIG. 4 housing, showing a sealing bead.
Figure 4:
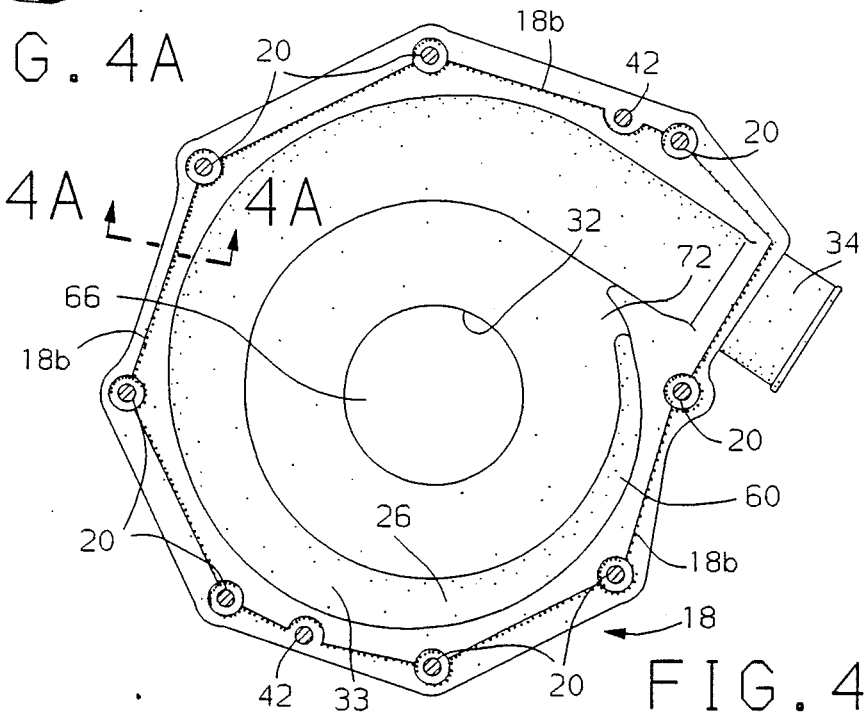
FIG. 4 is a view, indicated generally by line 4—4 of FIG. 1, of the housing removed from the air pump.
Figure 5:
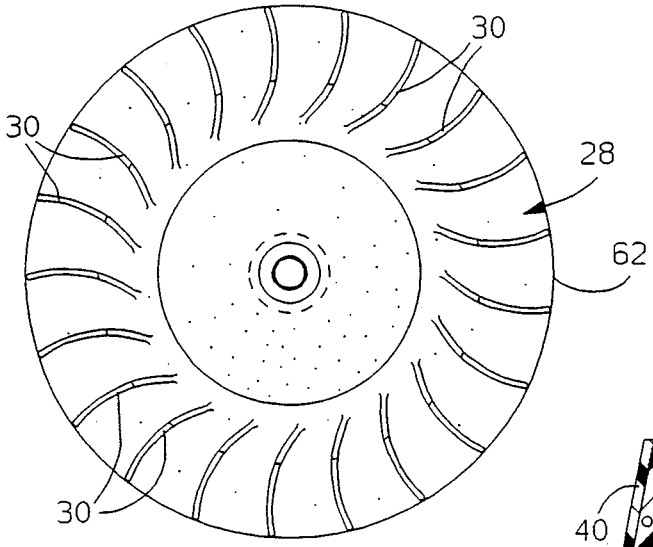
FIG. 5 is a view of the impeller removed from the air pump.

Referring first to FIGS. 1 through 7 of the drawings, an air pump 10 has an electric motor 12 secured by fasteners 14 to one side of a mounting plate 16, and a housing 18 secured by fasteners 20 to the opposite side of plate 16. The nose 22 of motor 12 nests in plate 16 and has a shaft 24 that extends into the working chamber 26 between plate 16 and housing 18. Shaft 24 supports and drives an impeller 28 in chamber 26. Impeller 28 has a plurality of blades 30 that are swept around chamber 26 to centrifugally induce air flow from a central axially oriented inlet fitting 32 into a peripheral scrolled region 33 that leads to an outlet fitting 34.

The operating characteristics of air pump 10 are exemplified by the following test results:

| pressure | flow | current | speed |
|---|---|---|---|
| 20.8 | 0 | 14.2 | 18462 |
| 19.7 | 7.1 | 14.6 | 18328 |
| 18.6 | 14.1 | 15.0 | 18058 |
| 18.0 | 17.3 | 15.1 | 17961 |
| 17.1 | 22.3 | 15.6 | 17784 |
| 15.6 | 29.9 | 16.4 | 17589 |
| 14.5 | 33.6 | 16.8 | 17411 |
| 11.5 | 41.5 | 17.8 | 17112 |
| 8.1 | 49.7 | 19.6 | 16820 |
| 4.3 | 56.8 | 21.2 | 16552 |
| 0 | 63.3 | 22.6 | 16281 |

Power was supplied at 13.5 volts DC, the pressure was measured as the difference between inlet fitting 32 and outlet fitting 34 in inches of water, the flow was measured in cubic feet per minute, the current was measured in amperes, and the speed was measured in revolutions per minute (rpm).

To attenuate the noise generated by a motor operating at those speeds, motor 12 is surrounded by an aluminum cover 36 secured to plate 16 by fasteners 38, a polypropylene shell 40 secured to plate 16 by fasteners 42 (FIG. 3), and foam pads 44 and 46 sandwiched between cover 36 and shell 40.

Figure 6:
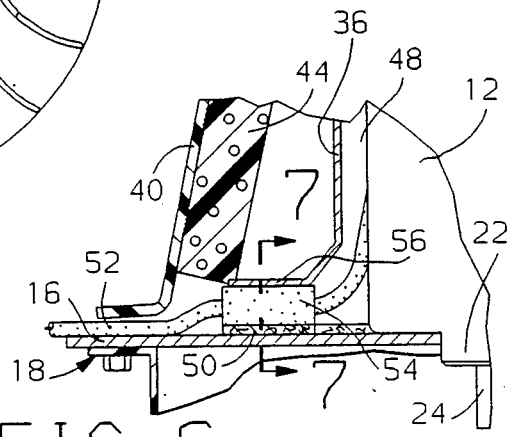
FIG. 6 is another, partial, axial sectional view of the air pump, showing entry of the electric motor power leads to the air pump.
Figure 7:
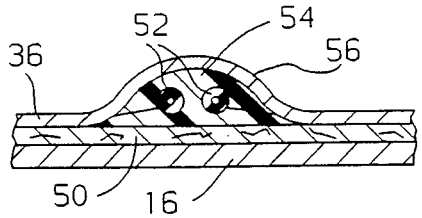
FIG. 7 is a sectional view, taken along line 7—7 of FIG. 6, showing the grommet that provides a seal around the power leads.
Figure 8:
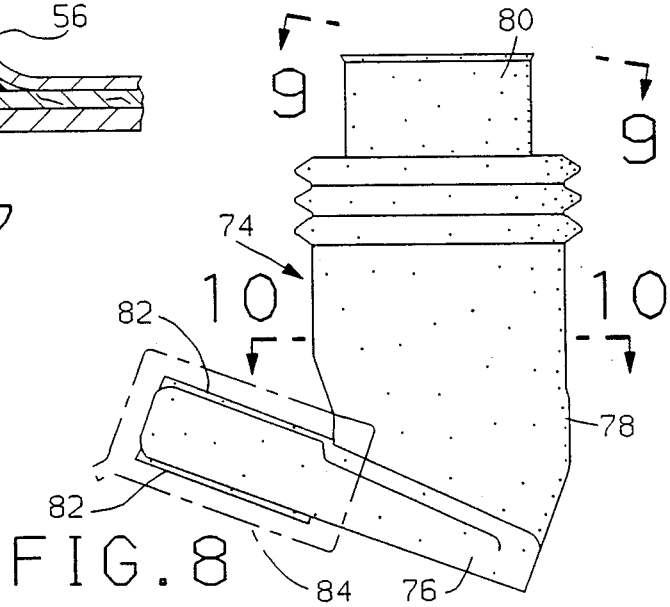
FIG. 8 is an enlarged elevation view of the inlet duct of FIG. 1, showing the duct removed from the remainder of the air pump.
Figure 9:
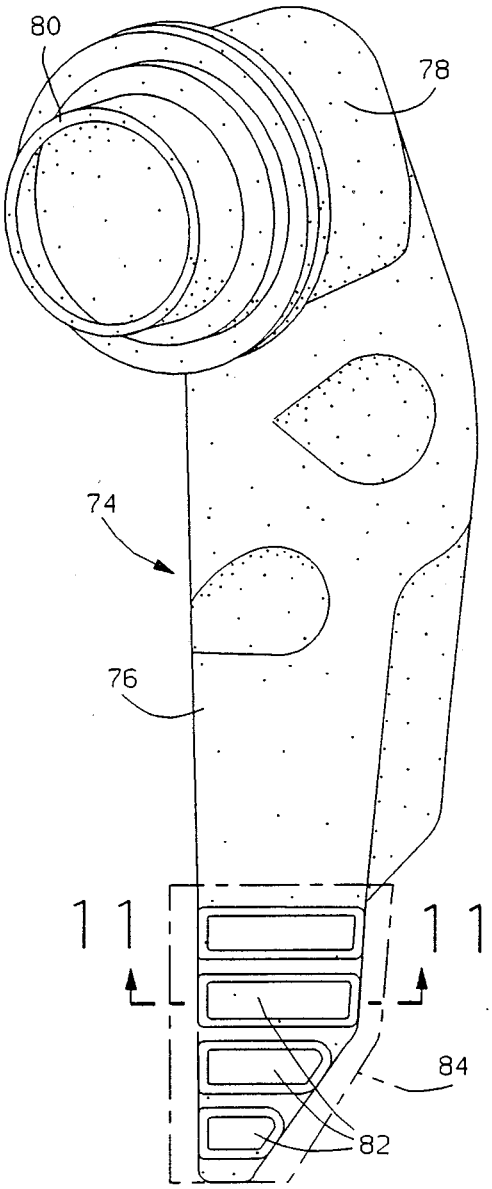
FIG. 9 is an end view, indicated by line 9—9 of FIG. 8, of the inlet duct.
Figure 10:
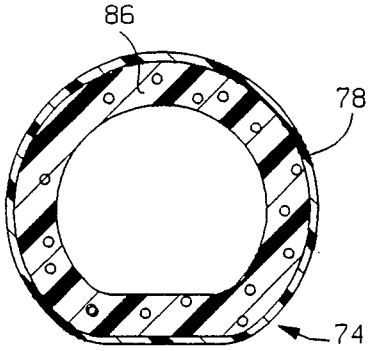
FIG. 10 is a sectional view, taken along line 10—10 of FIG. 8, showing noise attenuating material inside the duct.
Figure 11:
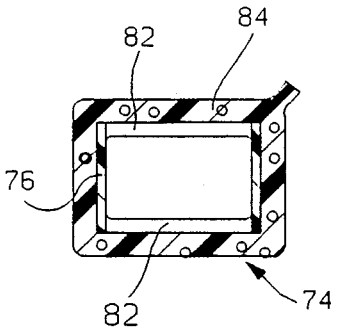
FIG. 11 is a sectional view, taken along line 11—11 of FIG. 9, showing a filter around the inlet louvers of the duct.

The chamber 48 surrounding motor 12 is sealed by a gasket 50 sandwiched between cover 36 and plate 16, and as shown in FIGS. 6 and 7, the power leads 52 for motor 12 enter chamber 48 through a grommet 54 received in a dimple 56 formed in the rim of cover 36.

Plate 16 has a series of six peripherally spaced apertures 58 opening to the motor chamber 48 from the high pressure zone 60 of working chamber 26, near the rim 62 of impeller 28. Plate 16 also has a series of four peripherally spaced apertures 64 opening from the motor chamber 48 to a central low pressure zone 66 of working chamber 26, near the nose 22 of motor 12. The back 68 of impeller 28 is spaced about 2 or 3 millimeters from plate 16. During operation, impeller 28 induces a portion of the air flow to recirculate from high pressure zone 60 through apertures 58, sealed motor chamber 48, and apertures 64 into low pressure zone 66. The recirculating air flow cools motor 12.

Power is supplied to motor 12 only when operation of air pump 10 is required. When used to supply air to the exhaust system of an automotive engine, outlet fitting 34 is connected through the conduits and control valves desired for the particular application, and an appropriate control supplies power to motor 12 only when air is required to support combustion in the engine exhaust system.

Within working chamber 26, the small end of scrolled region 33 is separated from the large end of scrolled region 33 by a land 72. Land 72 is tapered axially to avoid abrupt pressure changes as the impeller blades 30 are swept past land 72; tapered land 72 thereby minimizes generation of noise within the air pump.

If desired, the rim of housing 18 may include a bead **18*b* that seals directly against plate 16. Bead 18*b* obviates the need for a gasket between housing 18 and plate 16 while allowing very slight clearance between impeller 28 and housing 18**.

Referring now to FIGS. 8 through 11, an inlet duct 74 is provided to attenuate noise emitted from air pump inlet fitting 32. Duct 74 is formed of polypropylene and has an elongated neck 76, of generally rectangular cross-section, extending at an angle from a short generally tubular body 78. Body 78 extends to a fitting 80 adapted to be secured about pump inlet fitting 32. The upper or remote end of neck 76 is tapered, and at least two opposing sides have a series of parallel inlet louvers 82. Louvers 82 are surrounded by a filter 84 formed of open cell polyurethane foam. Body 78 also has an internal liner 86 formed of polyurethane acoustical foam.

I claim:

1. An air pump having an electric motor secured to one side of a mounting plate, and a housing secured to the opposite side of said plate, said motor having a shaft that extends into a working chamber defined between said plate and said housing, said shaft supporting and driving an impeller in said chamber to centrifugally induce air flow through said chamber, wherein a cover is secured to said plate and encloses said motor in a sealed chamber defined between said cover and said plate, said plate has a series of peripherally spaced apertures opening to said sealed chamber from the high pressure zone of said working chamber near the outer rim of said impeller, said plate also has a series of peripherally spaced apertures opening from said sealed chamber to a central low pressure zone of said working chamber between said plate and the back of said impeller, and said impeller induces a portion of the air flow to recirculate from said high pressure zone through said sealed chamber, about said motor and into said low pressure zone to cool said motor.

2. An air pump having an electric motor secured to one side of a mounting plate, and a housing secured to the opposite side of said plate, said motor having a shaft that extends into a working chamber defined between said plate and said housing, said shaft supporting and driving an impeller in said chamber to centrifugally induce air flow through said chamber, wherein a cover surrounds said motor, foam pads surround said cover, and a shell surrounds said foam pads, said cover, foam pads and shell being effective to attenuate the noise generated by said motor, and wherein said cover is secured to said plate and encloses said motor in a sealed chamber defined between said cover and said plate, said plate has a series of peripherally spaced apertures opening to said sealed chamber from the high pressure zone of said working chamber near the rim of said impeller, said plate also has a series of peripherally spaced apertures opening from said sealed chamber to a central low pressure zone of said working chamber between said plate and the back of said impeller, and said impeller induces a portion of the air flow to recirculate from said high pressure zone through said sealed chamber, about said motor and into said low pressure zone to cool said motor.

3. An air pump for delivering air to an engine exhaust system, said air pump having an electric motor secured to one side of a mounting plate and a housing secured to the opposite side of said plate, said motor having a shaft that extends into the working chamber defined between said plate and said housing, said shaft supporting and driving an impeller in said chamber to centrifugally induce air flow from a central axially oriented inlet fitting to a peripheral scrolled region that leads to an outlet fitting, wherein an inlet noise attenuating duct has a mounting fitting secured to said inlet fitting, said duct having an elongated neck of generally rectangular cross-section extending at an angle from a generally tubular body, said body extending to said mounting fitting, the remote end of said neck being tapered and opposing sides of said neck having a series of inlet louvers, and said body having an internal foam liner.

* * * * *